US010589554B2

(12) United States Patent
Koh et al.

(10) Patent No.: US 10,589,554 B2
(45) Date of Patent: Mar. 17, 2020

(54) PRINTER TO DETERMINE CALIBRATION PATTERN

(71) Applicant: Hewlett-Packard Development Company, L.P., Houston, TX (US)

(72) Inventors: Chin Hung Koh, Singapore (SG); Tong Nam Samuel Low, Singapore (SG); Kang Leng Tan, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/775,992

(22) PCT Filed: Mar. 17, 2016

(86) PCT No.: PCT/US2016/022913

§ 371 (c)(1),
(2) Date: May 14, 2018

(87) PCT Pub. No.: WO2017/160297

PCT Pub. Date: Sep. 21, 2017

(65) Prior Publication Data

US 2018/0326768 A1 Nov. 15, 2018

(51) Int. Cl.
*B41J 29/38* (2006.01)
*B41J 29/393* (2006.01)

(52) U.S. Cl.
CPC ..... *B41J 29/393* (2013.01); *B41J 29/38* (2013.01); *B41J 2029/3935* (2013.01)

(58) Field of Classification Search
CPC ... B41J 29/393; B41J 29/38; B41J 2029/3935
See application file for complete search history.

(56) References Cited

U.S. PATENT DOCUMENTS

| | | | | |
|---|---|---|---|---|
| 6,623,096 | B1 | 9/2003 | Castano et al. | |
| 6,637,853 | B1 | 10/2003 | Ahne et al. | |
| 7,156,482 | B2 | 1/2007 | Boleda et al. | |
| 7,588,302 | B2 | 9/2009 | Bastani et al. | |
| 8,757,762 | B2 | 6/2014 | Jimenez et al. | |
| 2005/0270325 | A1 * | 12/2005 | Cavill | B41J 29/393 347/19 |
| 2006/0274106 | A1 | 12/2006 | Park | |
| 2008/0170097 | A1 * | 7/2008 | Risson | B41J 29/393 347/19 |
| 2008/0225074 | A1 | 9/2008 | Van de Wynckel et al. | |
| 2009/0231374 | A1 | 9/2009 | Van De Wynckel et al. | |
| 2010/0238220 | A1 | 9/2010 | Yeh et al. | |
| 2012/0114188 | A1 | 5/2012 | Murase et al. | |
| 2015/0367662 | A1 | 12/2015 | Sender Beleta et al. | |

OTHER PUBLICATIONS

Bernal, et al. Improved Pen Alignment for Bidirectional Printing. http://proceedings.spiedigitallibrary.org/proceeding~Jan. 15, 2006~2 pages.

* cited by examiner

*Primary Examiner* — Sharon A. Polk
(74) *Attorney, Agent, or Firm* — HP Inc. Patent Department

(57) ABSTRACT

A printer is operated to determine an attribute of a field of view of the scan sensor. A calibration test pattern is determined based on the field of view (e.g., size of the field of view relative to dimension of individual bar in pattern).

15 Claims, 3 Drawing Sheets

PRINTER TO DETERMINE CALIBRATION PATTERN

BACKGROUND

Numerous types of printers exist, and increasing demand for printers has enabled printing technology to be accessible to consumers for home and business use. With prevalence of printing technology, print media (e.g., paper) and replacement components (e.g., ink) are also increasingly available to owners of printers. The sources of print media and replacement components can also range beyond what a printer manufacturer may have intended.

DETAILED DESCRIPTION

Figure 1:
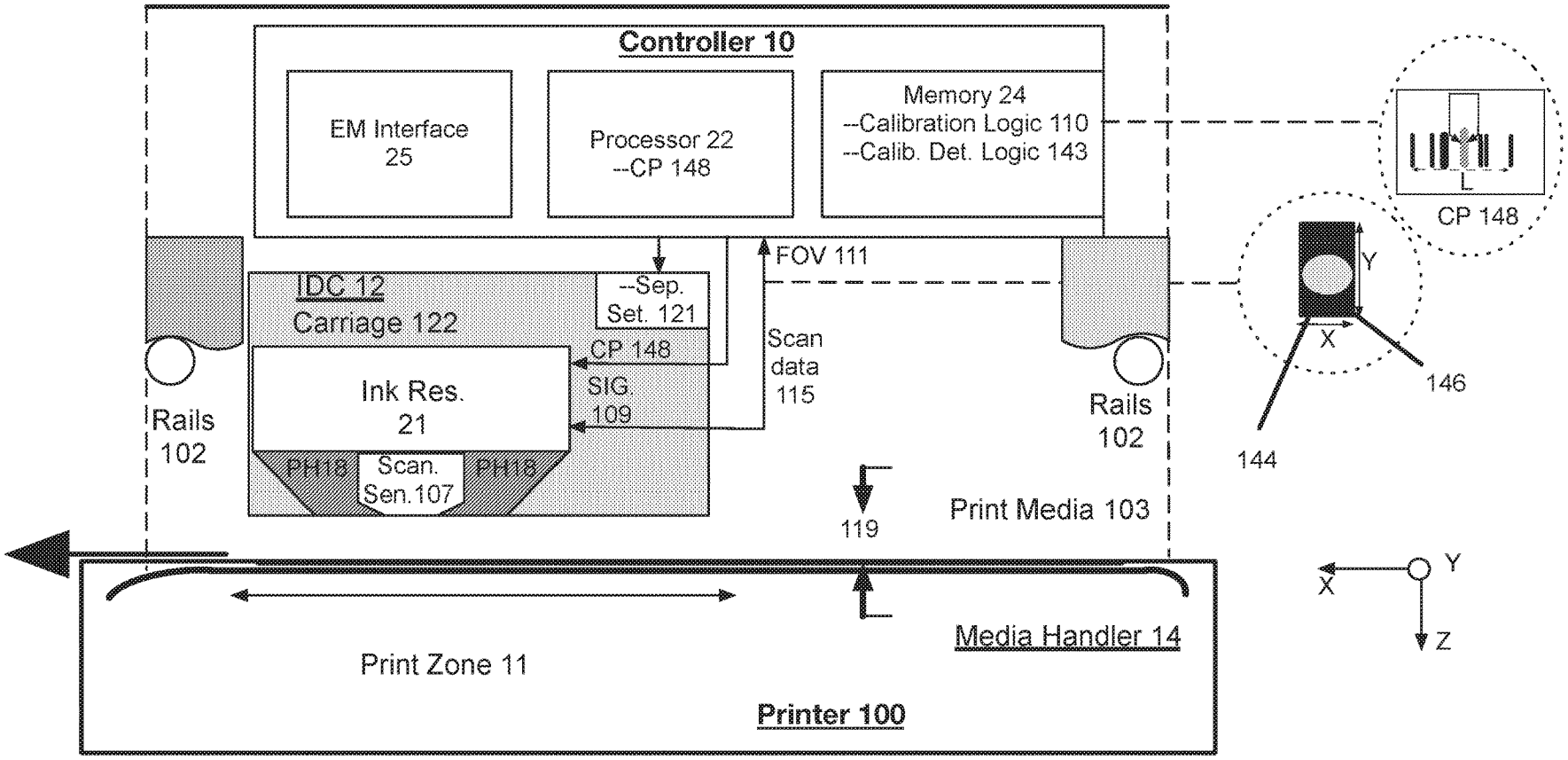
FIG. 1 illustrates an example printer for implementing adaptive print head pen positioning.

Examples include a printer that is operable to generate a calibration pattern (sometimes referred to as a test pattern) that is specific to the variances that are inherent in the operation of the particular printer.

In some examples, a printer generates a calibration pattern that is based on a dimensional attribute of the scan sensor's field of view. The determined calibration pattern can vary by, for example, dimensional characteristics of individual pattern elements, spacings between pattern elements, overall dimension of the calibration pattern, and optical density (e.g., how closely packed the elements of the calibration pattern are).

The term "calibration pattern" or "calibration test pattern" and variants thereof, include an arrangement or pattern of discrete elements which are visually (or optically) distinct from one another, through for example, spacing (e.g., dark elements separated by white or background). Numerous examples recite elements of the calibration pattern as "bars" although examples extend to alternative shapes such as lines, rounded elements etc. An example of a calibration pattern is an Automated Pen Alignment ("APA") pattern.

Still further, in some examples, the calibration test pattern can be used to determine a print zone profile for the printer. The print zone profile can reflect the presence of manufacturing or operational variances, such as, depth variations across the print media (e.g., corrugated media), stack up tolerances, warpage of the print media, tilt or misalignment of the carriage, platen variations and other variances.

In other variations, a printer is operated to determine an attribute of a field of view of the scan sensor. A calibration test pattern is determined based on the field of view (e.g., size of the field of view relative to dimension of individual bar in pattern). A swath of the calibration test pattern is used to determine a calibration setting for a print head of the printer.

While conventional printers utilize test patterns for calibrating print heads, such conventional approaches use static test patterns which cannot account for variances resulting from manufacturing variances (e.g., tolerances resulting from manufacturing) or operational variances (e.g., print media variations). Among other technical affects and advantages, examples enable a printer to dynamically generate a calibration pattern that accounts for such variances, enabling the printer to be calibrated for device-specific tolerances or variances resulting from print media. Furthermore, the test pattern can be generated without need to incorporate additional hardware into the existing deign of the printer.

Additionally, in some examples, printers can be provided with logic to enable retroactive ability to dynamically generate test patterns for purpose of calibrating the print head of the printer.

In some examples, the printer detects a depth variance in a print zone (e.g., resulting from media warpage) using a signal pattern output that is generated from scanning a selected calibration pattern.

A printer may scan a swath of a selected calibration pattern to generate a signal pattern output. The printer uses the signal pattern output to calibrate at least a print head for ink placement on a media along at least an axis of a plane of the media. A depth variance is determined, based at least in part on the signal pattern output, that affects placement of the ink on the media in at least a print zone, where the depth variance is relative to the plane of the media. A setting of the printer is adjusted to compensate for the depth variance.

Additionally, in some examples, a field of view is determined for a scan sensor of the printer. A calibration pattern is selected from multiple calibration patterns available to the printer based on the field of view of the scan sensor. The printer prints at least a swath of the selected calibration pattern, from which the signal pattern output is determined.

Examples recognize that the accuracy by which printers are able to align the dispersion of ink material on print media is affected by numerous internal and external factors which can limit the ability of printers to function as precisely as intended. For example, variances resulting from manufacturing and print zone tolerances can affect the positioning of the scan sensor, so that the field of view the scan sensor is not uniform across devices. Additionally, the alignment and interconnect of components within the printer can diverge over time and use, further exasperating existing variances and diminishing the quality of the output. This can adversely affect calibration processes performed through use of calibration patterns, such as APA calibration patterns.

Still further, media can vary in type and quality, with for example, static surface variations (e.g., corrugated media) and shape deformations as the media is advanced through the printer. Such variations and deformations are examples of depth variances which can cause misplacement of ink on the print media. Even when the degree of ink misplacement is relatively small, the presence of ink misplacement can still affect the apparent quality of a print job.

In contrast to conventional printers, an example printer is provided to dynamically determine calibration patterns which enable the printer to accommodate mechanical variances (e.g., with the positioning or operation of the scan sensor) and operational variances (e.g., warpage by the print media). As a result, some examples include printers that are more reliable as compared to conventional printers, particularly in terms of being able to precisely deposit ink material and create high quality prints. Moreover, in terms of maintaining precision with ink dispersion, examples as described provide for printers that durable and robust in ability to handle media of different types.

Still further, in some examples, the printer includes a memory that stores a set of instructions and a processor. The processor can execute the instructions to implement examples as described.

In some examples, the printer is operated to determine a sensor field of view value in a print zone of a print media. From a database of calibration pattern bar widths, a calibration pattern bar dimension matching the field of view value is selected. A swath of calibration pattern bars having the calibration pattern bar width is printed within the print zone. The swath of calibration pattern bars can be scanned to determine an output that is indicative of the printer's variances (e.g., mechanical variances). If the characteristic exceeds a predetermined threshold amount, the printer prints a continuous line that is superimposed on the swath of calibration patterns bars. The continuous line can then be scanned and compared to the output to determine a value of the indicated variance. The value can be correlated to an estimation of ink misplacement resulting from mechanical and operational variances.

FIG. 1 illustrates an example printer that is operable to dynamically generate calibration patterns for enabling calibration operations to be performed with respect to a print head. In an example of FIG. 1, a printer 100 includes a controller 10, an ink dispersion sub-system 12 and a print media handler 14. The print media handler 14 includes components which can operate under the control of controller 10, to grasp and manipulate print media against the ink dispersion sub-system 12 in order to generate printed media. The controller 10 may include a processor 22, a memory 24 and an electromechanical interface 25. The processor 22 can use instructions and setting information stored in the memory 24, amongst other data, to control the ink dispersion sub-system 12 and the print media handler 14. In some examples, the processor 22 can control operation of the ink dispersion sub-system 12 and the print media handler 14 via the electromechanical interface 25.

The ink dispersion sub-system 12 can include ink resource 21, having one or multiple print heads 18, and a carriage 122. By way of example, the ink resource 21 can be a pen-based ink resource. The carriage 122 includes a locomotive that enables the ink resource 21 to move under control of controller 10. For brevity, an example of FIG. 1 is described with reference to the print head 18, which can represent multiple print heads operating in synchronized or independent fashion. The ink dispersion sub-system 12 can also include, or otherwise be coupled to a scan sensor 107. In some implementations, the scan sensor 107 can include a combination of an illumination component and light sensor. In operation, the illumination sensor illuminates print media (e.g., paper) and detects reflected light from the print media using the light sensor. An attribute of the scan sensor's operation includes a field of view, corresponding to an area on the print media which is detectable to the light sensor. Accordingly, with reference to an example of FIG. 1, the scan sensor 107 includes a field of view from which scan operations can be performed utilizing print media 103.

The memory 24 may store instructions, which can be executed by the processor 22 to control the ink dispersion sub-system 12 (e.g. movement of the carriage 122, discernment of the ink, etc.) and the print media handler 14. As described with examples below, the memory 24 can store instructions for implementing calibration logic 110, which can be implemented by the processor to implement one or more calibration operations. The calibration logic 110 can include calibration pattern determination logic 143, which can be implemented by the controller 10 to dynamically generate a calibration pattern from which the controller obtains calibration values for positioning the print head 18. As described with other examples, the controller 10 dynamically generates a calibration pattern 148 that can account for mechanical or operational variances that affect the operation of the print head 18. By way of example, the controller 10 uses a dynamically generated calibration pattern to set or adjust a PPS setting for the print head 18, reflecting the vertical spacing of the print head with respect to a print media 103.

The print media handler 14 includes components that operate to expose physical media to the ink dispersion sub-system 12. As shown, the media handler 14 can grasp individual print media 103 from a tray that retains a stack of print media, and then advance the individual print media 103 past the print head 18. In implementations, media handler 14 includes electromechanical parts which can also be controlled by controller 10 to grasp and/or advance the print media (e.g., individual pieces of paper) past the print head 18. When the print media is advanced, the controller 10 can control the print head 18 of the ink dispersion sub-system 12 to release ink onto the printed media 103 in accordance with a predetermined pattern (e.g., print job).

With reference to an example of FIG. 1, a direction of media advancement is represented by X, and a plane of the media can be defined by X and Y (into paper). A depth relative to the plane of the media is shown by Z. While an example of FIG. 1 shows lateral advancement of the print media 103, numerous variations exist for alternating a direction of advancement of the print media (e.g., vertically).

According to some examples, the printer 100 can be operated to compensate for mechanical and/or operational variances which can affect alignment and positioning of the print head 18 relative to a media (e.g., paper). In some examples, at least one setting that controls the separation distance of the print head 18 and the advancing media 103 can be calibrated to account for a print zone profile. The print zone profile can identify notable operational variances, such as a depth profile of a selected print media (e.g., media warpage, corrugated media, etc.). The print zone profile can also identify manufacturing variances, resulting from, for example, stack up tolerances warpage of the print media, tilt or misalignment of the carriage, platen variations and/or other facets.

In an example of FIG. 1, the controller 10 implements the calibration pattern determination logic 143 to determine a calibration pattern 148 that is specific to the printer 100. In particular, the pattern determination logic 143 may determine the calibration pattern 148 based on a dimensional attribute of a field of view for the scan sensor 107. According to one implementation, the controller 10 signals 109 the scan sensor 107 to generate a spot beam (e.g., via an LED light source) of a given diameter on a surface of print media 103 in order to measure light reflected back from the surface of that print media. The controller 10 can signal 109 the scan sensor 107 to generate field of view (FOV) data 111 that indicates the dimensional attribute of the field of view for the scan sensor 107.

In an example of FIG. 1, the FOV data 111 is used to generate a FOV representation 144 that compares a dimensional attribute of the field of view to a width of a bar 146 of a calibration pattern 148. From the comparison, one implementation provides that individual bars 146 of a calibration pattern 148 are determined, and the calibration pattern 148 is generated to replicate the bar or pattern of bars for a given length. Once determined, the calibration pattern 148 can be stored in memory 24 for subsequent use in calibration operations of the printer 100.

In determining the calibration pattern 148, one example provides for the attribute of the calibration pattern 148 to be dynamically determined, based on specific manufacturing or operational variances of the printer 100. Specifically, examples as described provide that calibration patterns can be determined and adjusted dynamically, based on printer-specific variances that result from manufacturing and use, as well as operational variances (e.g., variances which are present in the print zone 11). In particular, examples recognize that the inherent alignment between the scan sensor 107 and the print head 18 can be leveraged to estimate the presence of variances brought on by, for example, the mounting of the ink dispersion sub-system 12 (e.g., mounting angle or height of print head 18), as well as the variances which may be present with the print zone (e.g., that variance within the media, stack up tolerances, height of plate and ribs, warpage of the print media, tilt of the carriage, platen droop and/or flute size). Thus, for example, the calibration pattern for the printer 100 can reflect the accumulation of various tolerances resulting from manufacturing or use of the printer 100.

In one implementation, the calibration pattern 148 can provide for uniformly dimensioned bars 146, each of which have widths determined from the dimension of the FOV representation 144. As shown by an example of FIG. 1, an example selects the calibration bar 146 to have the maximum width which fits within the field of view of the scan sensor 107, as represented by the FOV representation 144.

In variations, the calibration pattern 148 can have other attributes determined from the FOV representation and/or FOV data 111. For example, the opaqueness of individual bars 146, and/or spacing between individual bars 146 can be determined from alternative forms or characteristics of the FOV data 111 (e.g., reflective brightness captured through the optical sensor of the scan sensor 107). Likewise, the spacing between individual bars 146 can be based on the width of the individual bars and, for example, an over all dimension of the calibration pattern 148. Still further, in other variations, the determined attribute of the calibration pattern 148 can be varied across the length of the calibration pattern. For example, the FOV representation 144 can be obtained at different locations of the print zone 11, using the edge of the print media as a reference. Each of the FOV representations 144 can be used to determine the width of an individual bar for the calibration pattern 148. For example, each bar may be selected to have a width that is the maximum dimension which fits within the FOV representation 144. When multiple FOV representations 144 are determined over length of the print zone 11, the dimension (e.g., width) of the corresponding individual bars 146 may vary over the length of the calibration pattern 148.

In other variations, multiple calibration patterns 148 are stored in the memory 24. The controller 10 can select the calibration pattern 148 that is deemed to have the most optimal attribute (e.g., bar width, optical density, overall length etc.) to compensate for variances which may affect the adjacent print head 18. The controller 10 can then direct the ink dispersion sub-system 12 to dispense the selected calibration pattern 148 on the advancing media 103. The controller 10 can signal 109 the scan sensor 107 to scan the selected calibration pattern 148 to generate the calibration scan data 115.

According to some examples, the controller 10 can determine, from the the calibration scan data 115, a separation setting 121 (or adjustment to a default value for the setting) to control the separation distance 19 of the print head 18 and the print media 103. In an example of FIG. 1, the separation setting 121 is shown as control input for the carriage 122 of the ink dispersion sub-system 12. In variations, the positioning of other components can also be controlled through the separation setting 121. The media handler 14 may also include a component that can be controlled by a setting to grasp, manipulate and advance the print media 103 into position relative to the print head 18. Still further, the print head 18 can be controlled through the separation setting 121, separate or in combination with a corresponding setting for the carriage and/or the media handler 14. In this way, the controller 10 can implement the calibration logic 110 to determine and adjust the separation setting (or alternatively multiple separation settings) so as to control the relative separation distance 19 of the print head 18 and media 103. Additionally, the printer 100 can compensate for various manufacturing and/or operational variances that may otherwise affect the printing quality of the printer.

With further reference to FIG. 1, the controller 10 can execute the calibration logic 110 and calibrate the print head 18 along the Y axis, or X and Y axis, using the scan data 115. Additionally, the controller 10 can correlate the scan data 115 to a representative signal pattern that is characteristic of the print zone. As described in greater detail, the representative signal pattern can be used to selectively adjust the separation setting 121, thus affecting the separation distance 19 between the print media 103 and the print head 18. For example, the separation distance 19 can be adjusted between 1 mm and 2 mm based on the separation setting 121.

Figure 2A:
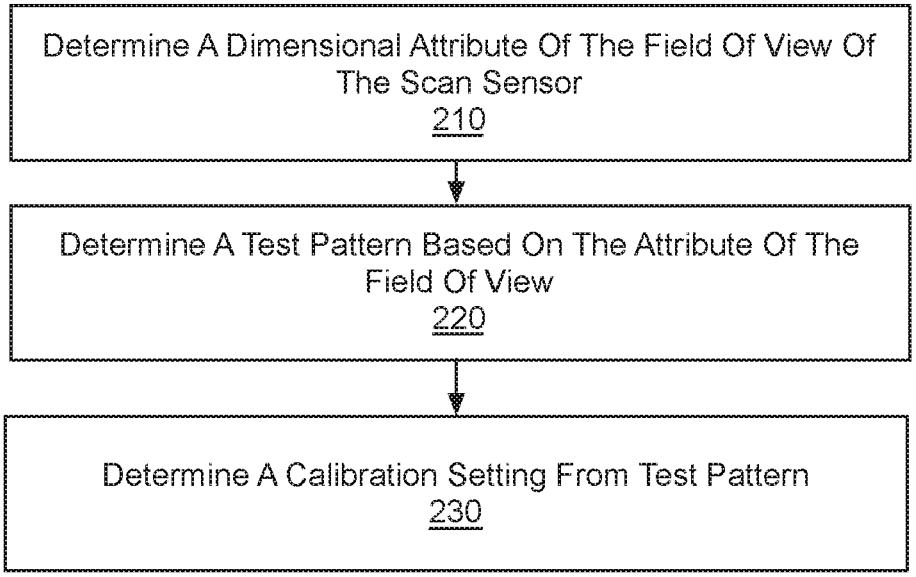
FIG. 2A illustrates an example method for operating a printer to select a calibration pattern from an output of a scan sensor.
Figure 2B:
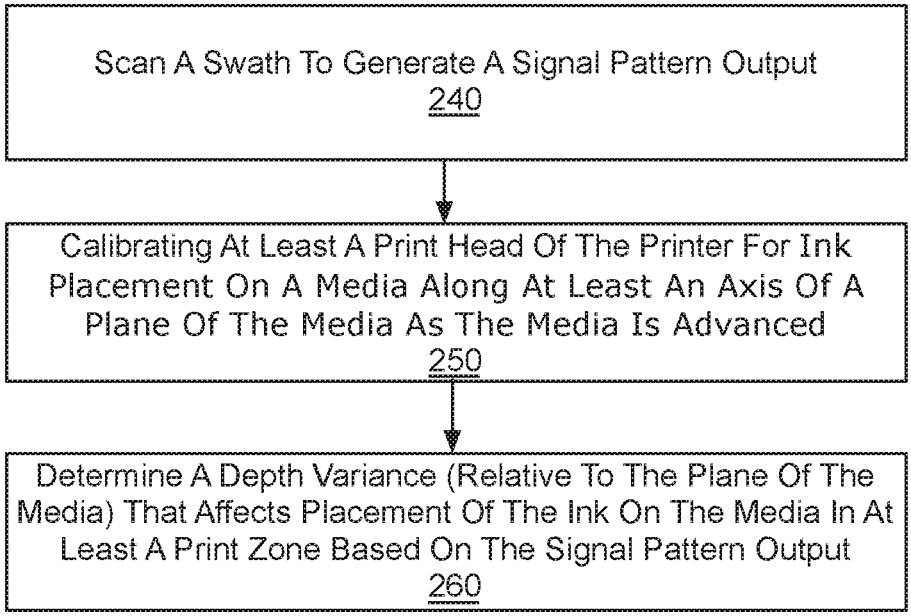
FIG. 2B illustrates an example method for operating a printer to perform calibration operations.
Figure 3A:
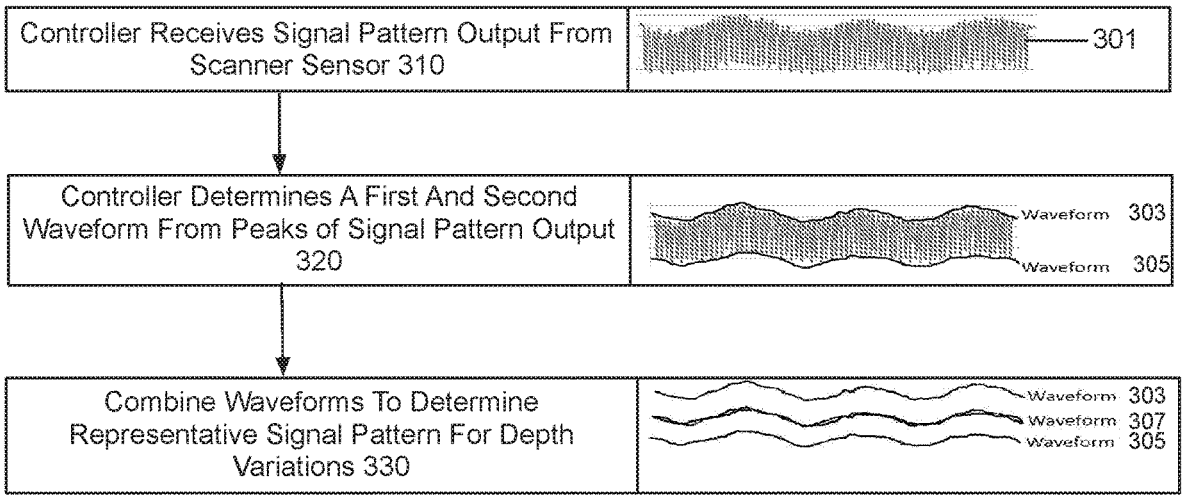
FIG. 3A illustrates an example method for operating a printer to correlate a signal pattern output from a scan sensor to a representative signal pattern for depth variances of the print zone.
Figure 3B:
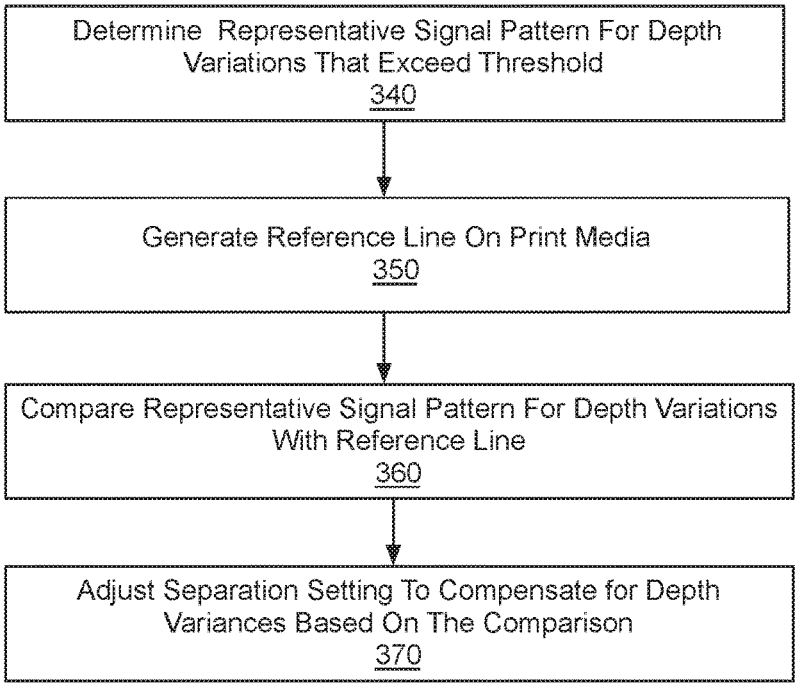
FIG. 3B illustrates an example method for operating a printer to use a representative signal pattern to adjust a separation setting of a print head for print zone variances.

FIG. 2A illustrates an example method for operating a printer to select a calibration pattern from an output of a scan sensor. FIG. 2B illustrates an example method for operating a printer to perform calibration operations. FIG. 3A illustrates an example method for operating a printer to correlate a signal pattern output from a scan sensor to a representative signal pattern for depth the printer's print zone. FIG. 3B illustrates an example method for operating a printer to use a representative signal pattern to adjust a separation setting of a print head for a print zone. In describing examples of FIG. 2A, FIG. 2B, FIG. 3A and FIG. 3B, reference may be made to elements of FIG. 1 for purpose of illustrating a suitable component or feature for performing a step or sub-step being described.

In FIG. 2A, the controller 10 operates the scan sensor 107 to determine a dimensional attribute of the field of view for the scan sensor (210). For example, the controller 10 can signal 109 the scan sensor 107 to generate the field of view with the edge of the print media 103 used as a reference. The scan sensor 107 may also obtain other field of views from the print zone 11 of the printer 100, using a reference such as the edge of the print media The scan sensor 107 may signal FOV data 111 to the controller 10, from which a dimensional attribute (e.g., diameter) of the field of view can be determined.

The controller 10 determines a calibration pattern for the printer 100 using the dimensional attribute of the field of view (220). In one implementation, the diameter of the field of view is used to select a width of an individual bar of the calibration pattern, and the calibration pattern can duplicate the bar over a length of the calibration pattern, or a portion thereof.

For example, ad described with FIG. 1, an individual bar 146 can be selected for the calibration pattern based on a diameter (d) of the FOV representation 144 completely enclosing the bar. A calibration pattern can then be generated by replicating the at least one bar 146. The dimension of the test pattern can further impact the optical density of the pattern. Still further, the calibration pattern 148 can be varied over its length if the maximum dimension of the bar (which can be enclosed by the field of view of the scan sensor) changes as a result of, for example, variances in the print zone 11. In some variations, the scan sensor 107 can be repositioned at several locations along the print zone 11 of the printer 100 in order to generate different FOV representations 144, from which the diameter or other dimensional attribute of the individual bar can be obtained. In this way, the calibration pattern 148 that is generated can be varied over the length of the calibration pattern. Likewise, attributes of the calibration pattern which can be determined from the FOV data 111 include optical density, overall length of the calibration pattern 148, and the spacing between individual bars 146 of the calibration pattern 148.

Once the calibration pattern is determined, the calibration pattern is then used to determine the calibration setting (230). For example, a separation setting 121 of the print head 18 may be determined from scanning the calibration pattern 148 and obtaining calibration scan data 115.

With reference to an example of FIG. 2B, the printer may use the calibration pattern determined from performing an example of FIG. 2A in order to implement calibration operations. The printer 100 can implement the calibration operations by printing and scanning a swath of the determined calibration pattern (240). The resulting san data 115 can be processed to calibrate at least the print head 18 of the printer 100 for ink placement on print media that is passed along an axis of a plane of the print media as it is advanced (250). The calibration can involve, for example, determining the PPS value for the printer 100.

Additionally, as described with an example of FIG. 3A and FIG. 3B, the scan data 115, used to calibrate the print head 18 on the print media, can be used for purpose of determining a depth variance of the print zone 11 (relative to the plane of the media) (260). The depth variance can reflect, for example, an operational variance, such as resulting from warped or corrugated print media.

With reference to an example of FIG. 3A, the swath of the determined calibration pattern is scanned using, for example, the scan sensor 107 (310). As a result, the calibration scan data 115 is obtained. At least a print head of the printer is calibrated for ink placement on the print media 103 along at least an axis of a plane of the print media (320). For example, in FIG. 1, the calibration can affect the placement of the ink in the direction of X and Y.

Separate from the calibration, a depth variance can be determined as between the plane of the media 103 and the print head using a signal pattern output of the scan sensor 107. The depth variance (or variances) may affect placement of the ink on the media in at least the print zone 11. As described with other examples, the determined depth variance can be determined from a representative signal pattern, such as shown with the combined waveform 307 (see FIG. 2A).

FIG. 3A and FIG. 3B provide examples for operating the printer 100 to dynamically determine a calibration pattern that enables the printer 100 to compensate for operational variances, including recently developed conditions or transitory uses or conditions (e.g., specific media type or environmental factor). For example, as described with FIG. 1, the use of warped or corrugated media can result in depth variances in the profile of the print zone, and the original calibration settings of the printer can become inadequate to properly compensate for such variances. Accordingly, in some examples, the calibration setting of the printer can be determined for a given print zone profile (e.g., instance of use with particular type of media). In such examples, the printer 100 can utilize alternative calibration patterns at different times of its operational life (e.g., when first produced versus with specific type of print media) in order to calibrate the printer 100 to compensate for variances in the print zone or other transitory conditions.

With reference to FIG. 3A, the controller 10 may receive a signal pattern output 301 from the scan sensor 107 of the printer 100 (310). The signal pattern output 301 may be a result of the controller 10 causing the scan sensor 107 to scan a calibration pattern, such as an APA calibration pattern.

The controller 10 determines a first and second waveform 303, 305 from peaks of the signal pattern output of the scan sensor 107 (320). Thus, for example, the first waveform 303 can represent a waveform formed by maximum peaks of the signal pattern output 301. Likewise, the second waveform 305 can represent a waveform formed by the minimum peaks of the signal pattern output 301.

The controller 10 can determine the representative signal pattern for the depth variation by combining (e.g., averaging the first and second waveforms 303, 305 (330). The combined waveform 307 can correspond to the representative signal pattern.

With reference to FIG. 3B, the representative signal pattern for depth variances can be determined from a method such as described with FIG. 3A. A determination can then be made as to whether the representative signal pattern exceeds a threshold (340). For example, if the combined waveform 307 exceeds a band, then the determination may be made that the threshold is exceeded. If the threshold is exceeded, then a reference line (or other shape) can be generated on the print media (350). The representative signal pattern (e.g., combined waveform 207) can be compared to the reference line to determine a value that indicates depth variances on the print media (360). The determined value can be mapped to the separation setting 121, which controls, for example, a separation distance between the print head 18 and the print media 103. The separation setting 121 can be mapped in this way to compensate for the existence of depth variances with respect to the print head 18 and the print media (370).

The example techniques may be performed by the processor(s) of printer 100 executing one or more sequences of instructions pertaining to the calibration logic 110 as stored in a non-transitory memory of printer 100. Such instructions may be read into the memory from machine-readable medium, such as memory storage devices. Execution of the sequences of instructions contained in the memory causes the processor(s) to perform the example method described herein. In alternative implementations, hard-wired circuitry may be used in place of, or in combination with, software instructions embodied in the calibration logic 110 to implement examples described herein. Thus, the examples described are not limited to any particular combination of hardware circuitry and software.

Although illustrative embodiments have been described in detail herein with reference to the accompanying drawings, variations to specific embodiments and details are encompassed by this disclosure. It is intended that the scope of embodiments described herein be defined by claims and their equivalents. Furthermore, it is contemplated that a particular feature described, either individually or as part of an embodiment, can be combined with other individually described features, or parts of other embodiments. Thus, absence of describing combinations should not preclude the inventor(s) from claiming rights to such combinations.

What is claimed is:

1. A method for operating a printer, the method comprising:

determining an attribute of a field of view of a scan sensor of the printer;

determining a calibration pattern based on the attribute of the field of view;

scanning a swath of the determined calibration pattern to generate a signal pattern output;

determining, based at least in part on the signal pattern output, a print zone profile for the printer; and determining a calibration setting for the printer based at least in part on the print zone profile.

2. The method of claim 1, wherein determining the calibration pattern includes:

determining a dimensional characteristic of individual elements or spacings between adjacent elements of the calibration pattern.

3. The method of claim 2, wherein determining the dimensional characteristic includes determining a width of an individual bar that forms a portion of the determined calibration pattern.

4. The method of claim 1, wherein determining the attribute of the field of view comprises determining a dimensional characteristic, wherein determining the dimensional characteristic includes determining an optical density of the calibration patterns.

5. The method of claim 2, wherein determining the attribute of the field of view comprises determining a dimensional characteristic, wherein determining the dimensional characteristic includes determining a variation of a characteristic of the individual elements of the calibration pattern over a length of the calibration pattern.

6. The method of claim 1, wherein determining the attribute of the field of view includes determining at least one of a shape or dimension of the field of view.

7. The method of claim 6, wherein further comprising printing multiple swaths of the determined calibration pattern, and wherein determining the depth variance is performed after printing a first of the multiple swaths.

8. The method of claim 1, further comprising:

calibrating, based on the signal pattern output, at least a print head of the printer for ink placement on a print media along at least an axis of a plane of the print media as the media is advanced.

9. The method of claim 8, wherein determining the print zone profile includes determining a depth variance, relative to the plane of the print media, that affects placement of the ink on the print media in at least a print zone; and adjusting a separation setting of the print head relative to the media to compensate for the depth variance.

10. The method of claim 9, wherein determining the depth variance includes determining a representative signal pattern of a surface of the media, the representative signal pattern being based on and different from the signal pattern output.

11. The method of claim 10, wherein the representative signal pattern is determined by combining a first waveform representing a maximum of the signal pattern output and a second waveform representing a minimum of the signal pattern output; and wherein determining the depth variance includes comparing a combined waveform of the first and second waveform to a continuous line.

12. The method of claim 1, wherein determining the attribute of the field of view is determined from an edge of a print media.

13. The method of claim 1, wherein determining the calibration pattern is based on matching a dimension of an individual element of the calibration pattern with the field of view of the scan sensor.

14. A printer comprising:

a controller, an ink interface component including carriage and a print head;

and a scan sensor;

the controller to:

determine an attribute of a field of view of a scan sensor of the printer;

determine a calibration pattern based on the attribute of the field of view;

determine a calibration setting for the printer using the calibration pattern; and calibrate, based on a signal pattern output, at least a print head of the printer for ink placement on a print media along at least an axis of a plane of the print media as the media is advanced.

15. A non-transitory computer-readable medium that stores instructions which, when executed by at least a processor of a printer, cause the printer to:

determine an attribute of a field of view of a scan sensor of the printer;

determine a calibration pattern based on the attribute of the field of view; and scan a swath of the determined calibration pattern to generate a signal pattern output;

determine, based at least in part on the signal pattern output, a print zone profile for the printer; and determine a calibration setting for the printer based at least in part on the print zone profile.

* * * * *